United States Patent [19]

Harano et al.

[11] Patent Number: 4,594,124

[45] Date of Patent: Jun. 10, 1986

[54] APPARATUS FOR THE PRODUCTION OF LAMINATED SHEATH CABLES

[75] Inventors: Fumio Harano; Shigeyoshi Kaneta; Kunihiro Nakagaki; Satoshi Nishiyama, all of Kanagawa, Japan

[73] Assignee: Sumitomo Electric Industries, Ltd., Osaka, Japan

[21] Appl. No.: 691,041

[22] Filed: Jan. 14, 1985

[30] Foreign Application Priority Data

Jan. 26, 1984 [JP] Japan ..... 59-13025

[51] Int. Cl.[4] ..... H01B 13/26

[52] U.S. Cl. ..... 156/468; 156/54; 156/499

[58] Field of Search ..... 29/33 D, 33 E; 72/367, 72/368; 156/53, 54, 443, 459, 461, 468, 499, 583.91

[56] References Cited

U.S. PATENT DOCUMENTS 2,936,357 5/1960 Crawford ..... 156/54 X 3,459,877 8/1969 Bullock et al. ..... 156/54 X

*Primary Examiner*—Robert A. Dawson

*Attorney, Agent, or Firm*—Sughrue, Mion, Zinn, Macpeak, and Seas

[57] ABSTRACT

A process and apparatus for the production of laminated sheath cables having improved close contact between a laminated tape layer and the core of the cable. The tape is longitudinally wrapped around the cable with portions of the tape overlapping. The assembly is then heated and passed through a set of pressing rollers disposed at a single pressing position. The rollers are at least three in number. The arc length of each roller is determined by dividing the total outer circumference of the assembled tape and cable core by the number of rollers.

5 Claims, 6 Drawing Figures

APPARATUS FOR THE PRODUCTION OF LAMINATED SHEATH CABLES

BACKGROUND OF THE INVENTION

The present invention relates to improvements in a process and apparatus for the production of a laminated sheath cable composed of a synthetic resin sheath and a cable core with a resin/metal composite laminating tape disposed between the sheath and the core and wound in an overlapping manner along the cable core.

A laminated sheath cable includes, as described above, a cable core, a laminating tape provided around the cable and wound in an overlapping manner along the cable core, and a synthetic resin sheath covering the outside of the laminating tape, which is usually a composite tape composed of a synthetic resin layer and an aluminum or copper layer that are bonded together. Heating at the time of sheath extrusion causes the resin layer to be fused to the sheath, as a result of which the laminating tape is fitted to the inside of the sheath.

FIG. 1 is a schematic illustration of a part of a conventional apparatus for the production of laminated sheath cables of this type. This conventional apparatus for the production of laminated sheath cables includes a cable core feeding reel 2 to feed a cable core 1, a laminating tape feeding pad 4 to feed a laminating tape 3 which is to be longitudinally wrapped on the cable core, a forming unit 5 used to wrap the laminating tape 3 onto the cable core 1 in an overlapping manner, a jig 6 used to prevent bunching of the overlapping portions (not shown) of the laminating tape 3, a squeezing die 7, a heating unit 8 for supplying hot air to render molten and thus fuse the overlapping portions, and pressing rollers 9 and 10 used to press together the overlapping portions which have been heated. These units are disposed in the stated order along the direction in which the cable core 1 moves.

The pressing rollers 9 and 10 are, as can be seen from the enlarged view of FIG. 2, offset from each other in the direction of movement of the core. As a result, forces X and Y are exerted on the cable core 1 at different positions in the lengthwise direction of the cable core 1. In this arrangement, the cable core 1 can readily ride off the rollers 9 and 10, reducing the pressing force used in fusing the overlapping portions of the tape. Consequently, a problem arises in that the overlapping portions cannot be bound together by a sufficiently large pressing force.

FIG. 3 is a partially cut-away cross-sectional view of the pressing rollers 9 and 10 as viewed from the side of the heating unit 8. If the overlapping portion A of the laminating tape 3 is turned to the side as shown in the drawing due to rotation of the cable core 1, the pressing directions X and Y of the pressing rollers 9 and 10 are away from the overlapping portion A. This gives rise to a disadvantage that the force of the pressing rollers 9 and 10 is not exerted efficiently.

SUMMARY OF THE INVENTION

An object of the present invention is thus to provide a process and an apparatus for the production of a laminated sheath cable in which the above-described disadvantages are eliminated and a sufficient adhesion strength of the laminating tape overlapping portions is always attained.

In accordance with the above other objects, the invention provides a process for the production of laminated sheath cable in which a laminating tape is longitudinally wrapped on a cable core in such a manner that the laminating tape is overlapping along the cable core, at least the overlapping portions of the laminating tape are heated, and thereafter the laminating tape on the cable core is pressed toward the center of the cable core by means of n rollers, each having a pressing portion of an arc length determined by dividing an outer circumference of the cable core by n, where n is an integer of 3 of more, whereupon the overlapping portions are always strongly bonded.

Also, an apparatus for the production of a laminated sheath cable is provided according to the present invention, which apparatus comprises a forming unit where a laminating tape is wrapped on a cable core in such a manner that the laminating tape is overlapping along the cable core, a jig for preventing the bunching of the laminating tape at the overlapping portions, a squeezing die to squeeze the cable core with the laminating tape wrapped thereon, a heating unit where the overlapping portions of the laminating tape are fused together by heating, and pressing means to press the overlapping portions. The above-mentioned units are disposed in the stated order along the cable core running direction. The pressing means comprises n rollers having a pressing portion having an arc length corresponding to an arc length determined by dividing the outer circumference of the cable core by n, where n is an integer of 3 or more. The rollers are arranged at a single position in the lengthwise direction of the cable core so as to uniformly press the laminating tape toward the cable core.

The present invention will hereinafter be explained with reference to the accompanying drawings.

DESCRIPTION OF THE PREFERRED EMBODIMENTS

Figure 4:
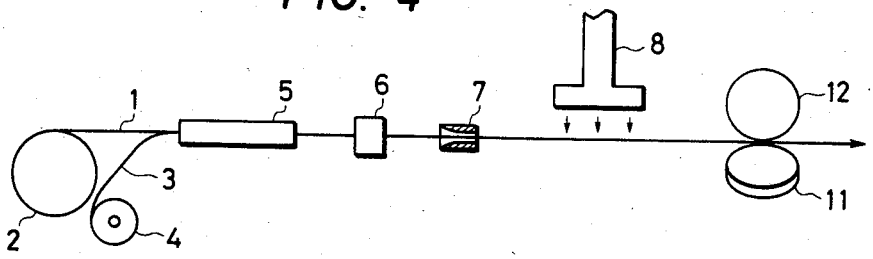
FIG. 4 is a schematic diagram illustrating a preferred embodiment of an apparatus of the present invention.

FIG. 4 is a schematic view illustrating a preferred embodiment of an apparatus for the production of laminated sheath cable according to the present invention.

Figure 1:
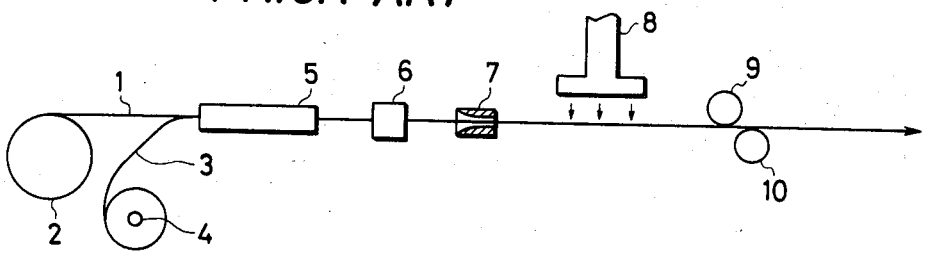
FIG. 1 PRIOR ART
FIG. 1 is a schematic view illustrating a conventional apparatus for the production of laminated sheath cables.

As is apparent from FIG. 1, the apparatus of this embodiment is provided with a cable core-feeding reel 2, a laminating tape feeding pad 4, a forming unit 5, a jig 6, a squeezing die 7, and a heating unit 8 as in the conventional apparatus shown in FIG. 1. Since these parts are equivalent to those in the conventional apparatus shown in FIG. 1, further explanations thereof are omitted and like reference numerals are applied.

An important feature of the apparatus of this embodiment resides in that, as the pressing device, three rollers 11, 12 and 13 (11 and 12 alone are shown in FIG. 4) are provided having a pressing portion (not shown in FIG. 4) having an arc length determined by dividing the outer periphery of the cable core 1 by 3, the number of rollers.

Figure 2:
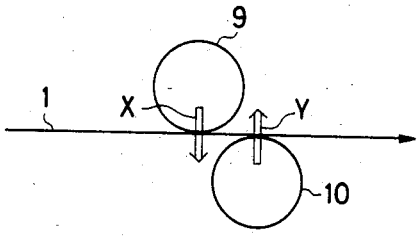
FIG. 2 PRIOR ART
FIG. 2 is an enlarged side view of a pressing mechanism of the apparatus of FIG. 1.
Figure 3:
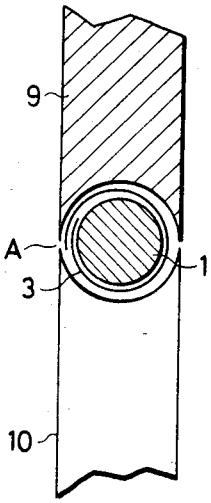
FIG. 3 PRIOR ART
FIG. 3 is a cross-sectional view of the pressing mechanism of FIG. 2 as viewed from a cable core feeding side.

As is apparent from FIG. 4, the rollers 11, 12 and 13 are disposed at a single position in the lengthwise direction of the cable core 1. Therefore, the problem of the cable core 1 riding off the pressing rollers as encountered in the conventional apparatus shown in FIG. 2 is overcome.

Figure 5:
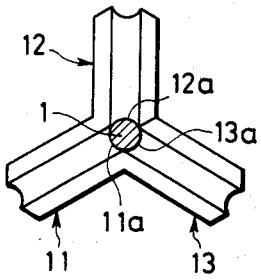
FIG. 5 is a front view of three rollers used in the embodiment of FIG. 4.

Due to the reaction force of the rollers 11, 12 and 13, the laminating tape 3 is brought into uniform close contact with the cable core 1. Thus, the overlapping portions of the laminating tape are surely bonded together. In the rollers 11, 12 and 13, as shown in FIG. 5 which is a view of the rollers 11, 12 and 13 in the cable core running direction, pressing portions 11*a*, 12*a* and 13*a* are each in the form of an arc of length determined by dividing the outer circumference of the cable core 1 by 3. Therefore, even if the position of the overlapping portions of the laminating tape 3 changes due to rotation of the cable core 1, the overlapping portions are still surely pressed by the rollers 11, 12 and 13. Thus, the reduction in the pressing force on the overlapping portions of the laminating tape are encountered in the conventional apparatus is prevented.

The rollers 11, 12 and 13 of this embodiment, as apparent from FIG. 5, are in close contact with the cable core 1 and the laminating tape (not shown) over the periphery thereof. Since, as described above, a reaction force opposing the force of the rollers 11, 12 and 13 is developed, the laminating tape is brought into close contact with the cable core 1. Therefore, the total outer diameter of the cable core 1 covered with the laminating tape can be reduced. This permits a reduction in the outer diameter of the cable, and also the use of a narrower laminating tape 3. In addition, the clearance between the cable core 1 and the laminating tape 3 is reduced by the close contact therebetween due to the force of the rollers 11, 12 and 13. Therefore, the force applied to draw the core 1 is increased.

Moreover, since the cable core 1 and the laminating tape 3 are pressed together along the same periphery, even if the position of the overlapping portions of the laminating tape 3 changes in the lengthwise direction of the cable core 1, it is not necessary to make the rollers 11, 12 and 13 follow such changes.

Figure 6:
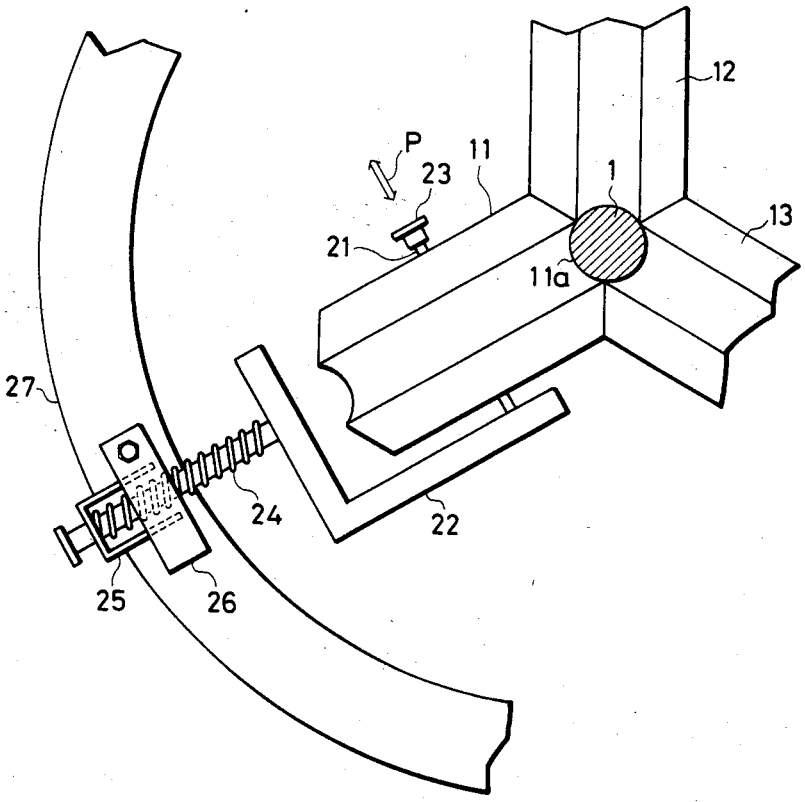
FIG. 6 is a partially cut-away front view of a supporting structure for the rollers of FIG. 5.

The supporting structure for the rollers 11, 12 and 13 will be explained with reference to FIG. 6.

A shaft 21 is fitted through the roller 11 and the roller 11 is supported rotatably thereabout. One end of the shaft 21 is secured to a bearing member 22 and the other end is provided with a screw 23 to adjust the location of the roller 11 in the axial direction of the shaft 21. The roller 11 can be moved in a direction indicated by the arrow P in FIG. 6 by rotating the position adjusting screw 23. The bearing member 22 is supported by a spring 24. The spring 24 is connected to a spring-receiving member 25 adapted to adjust the force of the spring and is secured to a rotatable supporting member 27 through a fitting 26. The spring 24 is provided so that the roller 11 can readily conform to fine variations in the outer diameter and unevenness in the lengthwise direction of the cable core 1 by adjusting the force of the roller 11 exerted on the cable core 1 by setting the force of the spring 24.

It can be appreciated that the overlapping portions of the laminating tape are very surely fused together by supporting the rollers 11, 12 and 13 constructed and mounted in the manner described above. Moreover, due to the presence of the spring 24, the cable core 1 and the laminating tape 3 provided on the cable core 1 are pressed together so that the overall diameter of the combination is reduced. Thus, it can be seen that the reduction in the diameter of the cable and the increase in the core drawing force are achieved efficiently.

The peeling strength of a cable produced using the rollers 11, 12 and 13 of the above embodiment of the invention and a cable produced using conventional pressing cable core 1, both having an outer diameter of 20 mm and both employing a laminating tape composed of a synthetic resin/aluminum composite tape bonded together, were compared. The aluminum/aluminum peeling strength was found to be as shown in the Table below:

TABLE

| Peeling Strength of Overlapping Portions | |
|---|---|
| Conventional Method | 2.0 to 4.0 kg/10 mm |
| Method of the Invention | 4.5 to 6.0 kg/10 mm |

As is apparent from the Table, when the apparatus of the present invention is used, the aluminum/aluminum peeling strength at the overlapping portions is markedly improved. In the above embodiment in which the outer periphery is divided into three parts, experimental results show that, for the three rollers 11*a*, 12*a* and 13*a* (see FIG. 6), the radius R of the arc of the pressing portion is preferably:

$$R = (\text{cable core diameter} + (0.0 - 1.0))/2 \text{ mm.}$$

The radius R of the pressing portion is chosen so as to be somewhat greater than that of the cable core 1. If, however, R is too large, it is not possible to properly apply the pressing force. It has been experimentally determined that the pressing force of the rollers 11, 12 and 13 in the above embodiment is preferably 3 to 6 kg. Even if the pressing force is increased beyond the above upper limit, no increase in the effect of reduction in outer diameter can be obtained. On the other hand, if it is less than 3 kg, an insufficient adhesive force is obtained.

It is preferred that the rollers 11, 12 and 13 be made of a hard material having a superior releasing property such as hard Teflon, metal, or Bakelite resin. The reason for this is that the plastic layer of the laminating tape has a tendency to stick to the rollers 11, 12 and 13, thereby preventing separation of the laminating tape from the rollers 11, 12 and 13. Of course, the rollers 11, 12 and 13 may be made of a material of lesser releasing properties. In such a case, however, it is preferred that a layer of a releasing material such as a fluorine resin be formed on the pressing portions 11*a*, 12*a* and 13*a* of the rollers 11, 12 and 13.

Although the explanation above refers to an embodiment in which three rollers are used, the present invention is not limited thereto. In addition, rollers resulting from the division of the outer periphery by 4 or more can be used.

In accordance with the present invention, as described above, a laminating tape is placed on a cable core in such a manner that the laminating tape is overlapping along the cable core, at least the overlapping portions of the laminating tape are heated, and thereafter the laminating tape wrapped on the cable core is pressed toward the center of the cable core by means of n rollers each having a pressing portion of arc length calculated by dividing the outer circumference of the cable core by n, where n is an integer of 3 or more. Thus, the overlapping portions of the laminating tape are surely fixed to the cable core.

Since the laminating tape is brought into close contact with the cable core by the pressing force of the rollers, a reduction in the outer diameter and thus in the finished diameter of the cable can be attained. Moreover, the amount of material needed for the sheath provided around the outside of the cable and the width of the laminating tape can be reduced. This permits the production of inexpensive laminated sheath cables. Moreover, since the cable core and the laminating tape are brought into close contact with each other by the pressing force of the rollers, the clearance therebetween is reduced, and thus the core-drawing force can be increased. Furthermore, even if the position of the overlapping portions of the laminating tape changes, it is not necessary to make the roller follow such changes. Thus, an improvement in production efficiency is attained with the invention.

It is to be noted that the present invention is applicable to all laminated sheath cables in which a laminating tape is provided on a cable core in such a manner that the laminating tape is wrapped in overlapping fashion along the cable core.

We claim:

1. An apparatus for the production of a laminated sheath cable, comprising, in order: a forming unit where a cable core is longitudinally wrapped with a laminating tape in such a manner that the laminating tape is overlapping along the cable core; an overlapping jig for preventing the overlapping portions of said laminating tape from bunching; a squeezing die for squeezing said cable core with said laminating tape provided thereon; a heating unit for rendering molten at least said overlapping portions of said laminating tape; and pressing means for pressing together the heated overlapping portions, wherein the improvement comprises: said pressing means comprises n rollers, each having a pressing portion having an arc length determined by dividing an outer circumference of said cable core by n, where n is an integer of 3 or more, disposed so as to press said laminating tape toward said cable core at a single position in the lengthwise direction of said cable core.

2. The apparatus as claimed in claim 1, wherein an arc radius R of the pressing portions of each of said rollers is:

$$R = (\text{cable core diameter} + (0.0 - 1.0))/2 \text{ (mm)}.$$

3. The apparatus as claimed in claim 1, wherein a pressing force of said rollers is 3 to 6 kg.

4. The apparatus as claimed in claim 2, wherein each of said rollers has a surface made of an easy releasing material.

5. The apparatus as claimed in claim 3, wherein an easy releasing resin layer is formed on said surfaces of each of said rollers.

* * * * *